US005145517A

United States Patent [19]

Feldstein et al.

[11] Patent Number: 5,145,517

[45] Date of Patent: Sep. 8, 1992

[54] COMPOSITE ELECTROLESS PLATING-SOLUTIONS, PROCESSES, AND ARTICLES THEREOF

[75] Inventors: Nathan Feldstein; Deborah J. Lindsay, both of Princeton, N.J.

[73] Assignee: Surface Technology, Inc., Trenton, N.J.

[21] Appl. No.: 701,291

[22] Filed: Mar. 11, 1991

Related U.S. Application Data

[60] Continuation of Ser. No. 510,770, Apr. 16, 1990, abandoned, which is a division of Ser. No. 137,270, Dec. 23, 1987, abandoned, which is a division of Ser. No. 822,335, Jan. 27, 1986, abandoned, which is a continuation of Ser. No. 598,483, Apr. 9, 1984, abandoned, which is a continuation of Ser. No. 408,433, Aug. 16, 1982, abandoned, which is a division of Ser. No. 249,773, Apr. 1, 1981, abandoned.

[51] Int. Cl.[5] ..... C09D 5/10; B22F 7/00; B05D 3/04; B05D 3/10

[52] U.S. Cl. ..... 106/1.05; 106/1.11; 106/1.27; 427/304; 427/305; 427/306; 427/438; 427/443

[58] Field of Search ..... 106/1.05, 1.11, 1.27, 106/1.25; 204/1 A, 14.1, 15, 23; 427/304, 443, 438, 383.7

[56] References Cited

U.S. PATENT DOCUMENTS

| | | | |
|---|---|---|---|
| 2,762,723 | 9/1956 | Talmey et al. | 117/130 |
| 2,822,294 | 2/1958 | Gutzeit et al. | 117/130 |
| 2,935,425 | 5/1960 | Gutzeit et al. | 117/130 |
| 3,348,969 | 10/1967 | Katz | 117/160 |
| 3,617,363 | 11/1971 | Metzger et al. | 117/130 |
| 3,661,596 | 5/1972 | Clauss et al. | 106/1 |
| 3,677,907 | 7/1972 | Brown et al. | 204/16 |
| 3,719,508 | 3/1973 | Gulla et al. | 106/1 |
| 3,782,978 | 1/1974 | Souza | 106/1 |
| 3,787,294 | 1/1974 | Kurosaki et al. | 204/16 |
| 4,160,707 | 7/1979 | Helle et al. | 204/37 |
| 4,302,374 | 11/1981 | Helle et al. | 260/29 F |
| 4,634,619 | 1/1987 | Lindsay | 427/97 |
| 4,716,059 | 12/1987 | Kim | 427/443 |
| 4,790,912 | 12/1988 | Holtzman et al. | 204/15 |
| 4,830,889 | 5/1989 | Henry et al. | 427/438 |

FOREIGN PATENT DOCUMENTS 3333121 3/1985 Fed. Rep. of Germany .

OTHER PUBLICATIONS

Reinhold, "The Condensed Chemical Dictionary", Eighth edition, 1971, pp. 327 and 821.

Helle, K. et al.,-Proceedings of Tenth World Congress on Mutual Finishing, Oct. 12-17, 1980, Kyoto, Japan, pp. 234-236.

G. A. Gawrilov, "Chemical (Electroless) Nickel Plating", Portcullis Press, 1979, pp. 18-25; 36-39; 164-167.

*Primary Examiner*—William R. Dixon, Jr.
*Assistant Examiner*—Michael Marcheschi

[57] ABSTRACT

A process of electrolessly metallizing a body on the surface thereof with a metal coating incorporating particulate matter therein, which process comprises contacting the surface of said body with a stable electroless metallizing bath comprising a metal salt, an electroless reducing agent, a complexing agent, an electroless plating stabilizer, a quantity of particulate matter which is essentially insoluble or sparingly soluble in the metallizing bath, and a particulate matter stabilizer (PMS), and maintaining said particulate matter in suspension in said metallizing bath during the metallizing of said body for a time sufficient to produce a metallic coating with said particulate matter dispersed therein.

37 Claims, No Drawings

COMPOSITE ELECTROLESS PLATING-SOLUTIONS, PROCESSES, AND ARTICLES THEREOF

REFERENCE TO PRIOR APPLICATIONS

This Application is a continuation of co-pending application Ser. No. 510,770 filed Apr. 16, 1990, now abandoned, which is a division of application Ser. No. 137,270 filed Dec. 23, 1987, now abandoned, which is a divisional application of application Ser. No. 822,335 filed Jan. 27, 1986, now abandoned, which is a continuation of application Ser. No. 598,483, filed on Apr. 9, 1984, now abandoned, which is a continuation of application Ser. No. 408,433, filed on Aug. 16, 1982, now abandoned, which is a divisional application of application Ser. No. 249,773, filed Apr. 1, 1981, now abandoned.

BACKGROUND OF THE INVENTION

Composite electroless coating containing particulate matter is a relatively new advancement in electroless (autocatalytic) plating. The subject of composite electroless coating with particulate matter appears to contradict earlier reports in the art of electroless plating, as well as some of the practices advocated by proprietary houses today.

Brenner, in U.S. Pat. Nos. 2,532,283 and 2,532,284, has described some of the basic concepts associated with electroless (autocatalytic) plating. In addition, Brenner and Riddell in Research, NBS 37, 1–4 (1946); Proc. Am. Electroplaters Soc., 33, 16 (1946); Research, NBS, 39, 385–95 (1947); and Proc. Am. Electroplaters Soc., 34, 156 (1947), have further discussed the electroless plating phenomenon and some of the precautions necessitated in effecting the process including awareness of the detrimental effect(s) associated with the presence of finely divided particles.

Gutzeit et al and Talmey et al in U.S. Pat. Nos. 2,819,187 and 2,658,839 have noted with great detail the sensitivity of electroless plating to homogeneous decomposition, some of which is caused by the presence of a solid insoluble phase.

U.S. Pat. Nos. 2,762,723 and 2,884,344 show some typical electroless plating stabilizers from the prior art used in the prevention of homogeneous decomposition. U.S. Pat. No. 3,234,031 shows some further electroless plating stabilizers of the prior art. A general review of conventional electroless plating stabilizers is noted in G. Salvago et al, Plating, 59, 665 (1972). The fundamental importance of the concentration of the electroless plating stabilizers used in the prior art is noted in Feldstein et al, J. Anal. Chem., 42, 945 (1970); Feldstein et al, J. Electrochem. Soc., 118, 869 (1971); Feldstein et al, J. Anal. Chem. 43, 1133 (1971); Feldstein et al, J. Electrochem. Soc., 117, 1110 (1970). In Electroless Nickel Newsletter, Edition II, Sep. 1980, in describing composite coatings the author concluded his survey: "Most conventional electroless plating baths are not well suited to composite plating, as the stabilizer is affected by the high concentration of particulate matter." The above publications and patents are incorporated herein by reference.

The previous findings stem from the recognition by those skilled in the art that electroless plating compositions are generally chemical systems which are thermodynamically unstable. Hence, any contamination may lead to the bulk of decomposition of the bath. Even at the present time, many commercially available proprietary electroless plating baths recommend that a mechanical filtration (through a 3 micron filter) should be incorporated to insure the maintainance of cleanliness in the electroless plating bath from insoluble foreign matter.

Despite previous findings it is now recognized that a wide variety of particulate matter may be incorporated in the electroless plating bath leading to the codeposition of the particulate matter along with the metallic or alloy matrix. In a German patent application No. B90776, included herein by reference, Metzger et al suggested the incorporation of insoluble particulate matter into the electroless plating bath to lead to composite coating. Though Metzger et al specified several plating baths of nickel, copper, and cobalt, there were no actual examples provided showing the codeposition and stability of such composite plating baths. Nevertheless, U.S. Pat. Nos. 3,617,363 and 3,753,667 were issued based upon the German application.

The following publication and the references therein are further provided: Electroless Nickel Coatings-Diamond Containing, R. Barras et al, Electroless Nickel Conference, Nov. (1979) Cincinatti, Ohio or N. Feldstein et al, Product Finishing July (1980) p. 65. They are included herein by reference.

In general it is noted that the electroless plating bath contains a metal salt as a source of the metal for the reduction, a complexing agent, a suitable reducing agent, a pH adjuster, and a stabilizer. Some prior art stabilizers are noted in the above cited publications and patents. The prior art stabilizers are known to act as "poisoning agents" of the catalytic sites.

For further appreciation of the state of the art a comprehensive review is noted by F. Pearlstein, Chapter 31 in "Modern Electroplating", 3rd Edition, Frederick A. Lowenheim editor 1974, John Wiley and Sons, Inc., publisher, which is included herein by reference. In Table I of this chapter typical composition(s) is noted both for acidic and alkaline type baths. The generic components of the bath include a nickel salt, sodium hypophosphite, a complexing agent, a pH modifier component, and a stabilizer (e.g., lead ions). The author notes that the formation of insoluble nickel phosphite interferes with the chemical balance of the solution by the removal of nickel ions, and has a detrimental effect on the quality of the deposit, and may also trigger spontaneous bath decomposition.

Regardless of previously encountered problems, in composite electroless plating baths the particulate matter which is being added, e.g., 5 micron of silicon carbide, has a surface area of about 2 meters$^2$/gram. The surface area is generally increased with decreased particle size. In fact, the surface area for the particulate matter contemplated in composite coatings and the present invention is greater than the recommended work load for plating. Pearlstein, in the above cited chapter (p. 718), notes that the bath's stability is adversely affected by excessive loads, and he suggests a limit of about 125 cm$^2$/l.

By contrast, an electroless plating bath with a few grams (e.g., 5 g/l) of finely divided particulate matter may result in an added surface area in the range of 100,000 cm$^2$/l which is significantly greater than the suggested load limit per plating volume solution.

From these semi-quantitative analyses the danger of adding the finely divided particulate matter is recognized. In fact, in conventional electroless plating continuous or semi-continuous filtration is recommended to remove finely divided matter. In addition, from the above reviewed state of the art, it is recognized that it is highly impractical to stabilize composite baths by the incorporation of extra stabilizer(s), (e.g., lead ions, thiourea, etc.). The addition of any significant extra stabilizer(s), though it may lead to bath stabilization, will also reduce significantly the plating value(s) to lower and impractical values.

Though composite coating by electroless plating is well documented in the above cited patents and publications, nevertheless there still remains major concern with the introduction of finely divided particulate matter having a high surface area. Yet, based on the above references, there does not appear to have been an effort toward the development of special baths with would serve the particular needs of composite electroless coatings.

It is thus the general and overall objective of the present invention to provide improved electroless plating baths particularly suitable for composite coatings which will provide longer viability as well as improved coating.

SUMMARY OF THE INVENTION

A process and articles for electroless plating incorporating particulate matter are described. The process and articles thereof comprise at least one distinct metallic layer comprising particulate matter dispersed therethrough. The process and articles so produced are derived from improved electroless plating bath(s) incorporating at least one particulate matter stabilizer.

DESCRIPTION OF THE INVENTION

According to the present invention a process is provided for producing articles metallized by electroless composite coating by contacting (directly or after pretreatment) the article to be plated with a conventional electroless bath along with finely divided particulate matter and a particulate matter stabilizer. The incorporation of the particulate matter stabilizer provides with improved stability of the plating bath and better quality and integrity for the resulting deposits.

In carrying out the present invention the article to be metallized is generally pretreated (e.g., cleaning, strike, etc.) prior to the actual deposition step. During the deposition process the particulate matter(s) is dispersed throughout the bath. The articles or substrates that are contemplated by the present invention vary from metals, alloys, and non-conductors, to semiconductors. For each specific substrate proper surface preparation is recommended prior to the composite coatings in order to insure ultimate good quality (e.g., adhesion) for the composite layer.

It is recognized that, in addition to the actual plating (deposition), it is highly desirable to provide an additional heat treatment step after the metallization of the surface (substrate). Such heat treatment below 400° C. provides several advantages: improved adhesion of the coating to the substrate, a better cohesion of matrix and particles, as well as the precipitation hardening of the matrix (particularly in the case of nickel phosphorus or nickel boron type coating).

The following terms are provided in this disclosure.

The term "electroless plating stabilizer" as used herein refers to chemicals which generally tend to stabilize conventional electroless plating baths from their homogeneous decomposition. In general these materials are used in low concentrations and their increased concentration often results in a cessation of or diminished plating rate. Typical materials are: lead, cadmium, copper ions, miscellaneous sulfur compounds, selenium, etc. All these materials are well documented in the prior art as related to conventional electroless plating. (See Chapter 31, Modern Electroplating, and above references.)

The term "particulate matter" as used herein is intended to encompass finely divided particulate matter, generally in the size range of 0.1 to about 150 micron. These particles are generally insoluble or sparingly soluble within the plating composition. These materials may be selected from a wide variety of distinct matter such as ceramics, glass, talcum, plastics, diamond (polycrystalline or monocrystalline types), graphite, oxides, silicides, carbonate, carbides, sulfides, phosphate, boride, silicates, oxylates, nitrides, fluorides of various metals, as well as metal or alloys of boron, tantalum, stainless steel, chromium, molybdenum, vanadium, zirconium, titanium, and tungsten. The particulate matter is suspended within the electroless plating bath during the deposition process and the particles are codeposited within the metallic or alloy matrix. The particulate matter codeposited may serve any of several functions, including lubricity, wear, abrasion, and corrosion applications, and combinations thereof. These materials are generally inert with respect to the electroless plating chemistry. Preferred particles are in the size range of 0.5 to 10 microns.

The term "electroless plating" or "electroless deposition" or "electroless bath" as used herein refers to the metallic deposition (from a suitable bath) of metals and/or alloys of nickel, cobalt, copper, gold, palladium, iron, and other transition metals, and mixtures thereof. These metals, or any other metals, deposited by the autocatalytic process as defined by the Pearlstein reference, fall within the spirit of this term. The electroless plating process may be regarded as the driving force for the entrapment of the particulate matter.

The term "particulate matter stabilizer" (PMS) as used herein refers to a new additive which provides greater stabilization, particularly to those electroless plating baths in which a quantity of finely divided particulate matter is being introduced. While we do not wish to be bound by theory, it is believed that the particulate matter stabilizer tends to isolate the finely divided particulate matter, thereby maintaining and insuring its "inertness" in participation in the actual conventional electroless plating mechanism (i.e., providing catalytic sites). The particulate matter stabilizer tends to modify the charge on the particulate matter, probably by some electrostatic interreaction and the alteration of the double layer. In general, the PMS will cause a significant shift in the zeta potential of the particulate matter when dispersed in water. PMS materials may be selected from the class of surfactants (anionic, cationic, nonionic and amphoteric types) as well as dispersants of various charges and emulsifying agents. In selecting a potential PMS care must be exercised so that its incorporation does not affect the basic kinetics of the plating process. In general, it has been noted that anionic PMS have caused a zeta potential shift of at least 15 mv, whereas cationic PMS have caused a zeta potential shift of at least 10 mv, though most caused a shift of 70 mv and above. Nonionic PMS have caused a zeta potential shift of at least 5 mv.

Zeta potential measurements were conducted on several kinds of particles: SiC '1200' (5μ); mixed diamonds (1-6μ); Ceramic - Microgrit Type WCA Size 3 (available from Microabrasives Corp.) The zeta potentials of these particles alone in D.I. water were determined as follows.

In each case a dispersion of 0.2 g of particles in 100 ml of D.I. water was prepared. Using a Zeta-Meter (manufactured by Zeta-Meter, Inc.), the dispersed particles were subjected to a direct electric field. The average time for the particles to traverse one standard micrometer division was measured, and the direction of movement was noted. With this information the zeta potential was determined from predetermined calibration curve(s) provided in the Zeta-Meter Manual ZM77.

A series of dispersions was prepared as above with the incorporation of each of the particulate matter stabilizers. 0.2 g of SiC '1200' was dispersed in 100 ml of several aqueous solutions having varying concentrations of the particulate matter stabilizer: 0.01, 0.05, 0.1, 0.5% by weight. The zeta potentials of the SiC particles were determined as above.

DETAILED DESCRIPTION OF THE INVENTION

The following examples are provided to demonstrate the concept of the present invention. However, the invention is not limited to the examples noted.

In order to demonstrate the effectiveness of the particulate matter stabilizer selected, commercial electroless nickel baths were selected. The commercial baths were modified with the incorporation of the particulate matter stabilizer(s). In order to determine the effectiveness of the incorporated additives, continuous plating was carried forth with continuous analysis of the plating bath and the replenishment of all the consumed ingredients.

In general, plating proceeded until bulk decomposition was noted. At that point, the percent nickel replenished was recorded. In certain cases which showed a significant improvement, the experiments were concluded even though decomposition had not been attained, and the effectiveness was noted.

As a test vehicle aluminum substrates were plated in the composite electroless baths.

In Examples 1-34 variations in PMS selected, particulate matter, and conventional electroless baths are noted. The results are noted below.

Appendix I provides further description for the PMS used along with type and chemical structure. Table 1 provides the resulting zeta potentials for silicon carbide particles with and without selected PMS added.

Use Test Results for Each Plating Bath/Particle System

| Example | Plating bath | Particulate Matter | PMS # | Conc'n (% by wt) | % Metal Replenished |
|---|---|---|---|---|---|
| 1 | Shipley 65 | SiC '1200' | control | — | 47.0 |
| 2 | Shipley 65 | SiC '1200' | 1 | 0.01 | 202.4 |
| 3 | Enthone 415 | Ceramic particles (Microgrit Type WCA size 3) | control | — | 331.5 |
| 4 | Enthone 415 | Ceramic particles (Microgrit Type WCA size 3) | 1 | 0.01 | >844.9 |

-continued

Use Test Results for Each Plating Bath/Particle System

| Example | Plating bath | Particulate Matter | PMS # | Conc'n (% by wt) | % Metal Replenished |
|---|---|---|---|---|---|
| 5 | Enthone 415 | Mixed diamonds (1-6μ) | control | — | 29.9 |
| 6 | Enthone 415 | Mixed diamonds (1-6μ) | 1 | 0.01 | >224.5 |
| 7 | Surface Technology HT Bath | Mixed diamonds (1-6μ) | control | — | 36.3 |
| 8 | Surface Technology HT Bath | Mixed diamonds (1-6μ) | 1 | 0.01 | >163.7 |
| 9 | Surface Technology HT Bath | Mixed diamonds (1-6μ) | 2 | 0.01 | >203.2 |
| 10 | Surface Technology HT Bath | Mixed diamonds (1-6μ) | 3 | 0.01 | >130.1 |
| 11 | Enthone 415 | SiC '1200' | control | — | 21.9 |
| 12 | Enthone 415 | SiC '1200' | 4 | 0.01 | 30.4 |
| 13 | Enthone 415 | SiC '1200' | 5 | 0.01 | 31.3 |
| 14 | Enthone 415 | SiC '1200' | 6 | 0.01 | 35.1 |
| 15 | Enthone 415 | SiC '1200' | 7 | 0.01 | 48.1 |
| 16 | Enthone 415 | SiC '1200' | 8 | 0.01 | 49.9 |
| 17 | Enthone 415 | SiC '1200' | 9 | 0.05 | 55.0 |
| 18 | Enthone 415 | SiC '1200' | 10 | 0.01 | 55.5 |
| 19 | Enthone 415 | SiC '1200' | 11 | 0.01 | 56.0 |
| 20 | Enthone 415 | SiC '1200' | 12 | 0.01 | 57.7 |
| 21 | Enthone 415 | SiC '1200' | 13 | 0.01 | 58.0 |
| 22 | Enthone 415 | SiC '1200' | 14 | 0.1 | 58.25 |
| 23 | Enthone 415 | SiC '1200' | 15 | 0.01 | 60.6 |
| 24 | Enthone 415 | SiC '1200' | 3 | 0.01 | 62.0 |
| 25 | Enthone 415 | SiC '1200' | 16 | 0.01 | 65.0 |
| 26 | Enthone 415 | SiC '1200' | 17 | 0.01 | 68.6 |
| 27 | Enthone 415 | SiC '1200' | 18 | 0.5 | 71.1 |
| 28 | Enthone 415 | SiC '1200' | 19 | 0.01 | 81.1 |
| 29 | Enthone 415 | SiC '1200' | 1 | 0.01 | 120.0 |
| 30 | Enthone 415 | SiC '1200' | 2 | 0.01 | 153.1 |
| 31 | Enthone 415 | SiC '1200' | 20 | 0.01 | 259.5 |
| 32 | Enthone 415 | SiC '1200' | 21 | 0.01 | >336.2 |
| 23 | Enthone 415 | SiC '1200' | 15 | 0.01 | 60.6 |
| 14 | Enthone 415 | SiC '1200' | 6 | 0.01 | 35.1 |
| 24 | Enthone 415 | SiC '1200' | 3 | 0.01 | 62.0 |
| 33 | Enthone 415 | SiC '1200' | 15 + 6 | 0.01 + 0.01 | 226.7 |
| 34 | Enthone 415 | SiC '1200' | 15 + 3 | 0.01 + 0.01 | >740.0 |

These proprietary commercial baths comprise an aqueous solution of a nickel salt and a reducing agent.

The Shipley 65 electroless plating bath is comprised of ammonium ions.

TABLE 1

Zeta Potentials (in mv) of SiC particles in aqueous solutions of the PMS's at the concentrations employed in the use test.

| PMS # | Zeta Potential (mv) |
|---|---|
| 1 | −68 |
| 2 | −66 |
| 3 | +48 |
| 4 | −64 |
| 5 | −64 |
| 6 | −52 |
| 7 | −67 |
| 8 | −45.5 |
| 9 | — |
| 10 | −64 |
| 11 | −57.5 |
| 12 | −64 |
| 13 | −64 |
| 14 | +70 |
| 15 | −40 |
| 16 | −53 |
| 17 | −47 |
| 18 | +57 |
| 19 | −47 |
| 20 | −64 |
| 21 | — |

Footnote:
The zeta potential of SiC in D.I. Water is −33 mv.

The concentrations of the particulate matter stabilizers used in Table 1 are the same concentrations as were used for the specific particulate matter stabilizers in the plating experiments (use test).

Example 1 through 32 show the significant and beneficial effect associated with the incorporation of the particulate matter stabilizers. In general, the concentration for the particulate matter stabilizers is from about 0.01 to about 0.5% by weight. In certain of the cases, as in Example 4, the actual percentage of metal replenished is higher than indicated, due to the fact that the experiment was discontinued once the significant beneficial effects were noted.

As can be seen from Appendix I, the various PMSs not only differ in type, e.g., nonjonic, cationic, anionic, or amphoteric, but they also differ in chemical structure. For example, the useful stabilizers include nonfluorinated organic compounds, e.g., salts of alkyllauryl sulfonates (1, 10, 11, 13, 16); alkyl sulfonates (2, 5, 6, 9, 12, 20); amine or ammonia containing hydrocarbons (12, 14, 18, 19); and essentially straight chain hydrocarbons (14, 145, 17, 21) as well as fluorinated organic compounds and sulfonated salts thereof (4, 7, 8). (The numerals above refer to the materials as set forth in Appendix I).

Comparison of the various results shows that the nature of the particulate matter used plays a significant role in the results of the controlled experiments. For instance, the inclusion of ceramic particles appears to be more compatible than the silicon carbide in the same plating bath. Consequently, it is not surprising that the inclusion of the particulate matter stabilizer in a specific bath with varied particulate matter results in a different level of metal plated.

In addition, from the relative results using different baths and the same particles and the same particulate matter stabilizer, it appears that the particulate matter stabilizer, though it improves the plating in certain of the baths, does not provide the improvement to the same level in each case. While we do not wish to be bound by theory, it is postulated that competitive reactions of adsorption and/or absorption of the particulate matter stabilizer onto the particulate matter may be reversed by the presence of certain complexing (or chelating) agents, which are part of conventional electroless plating baths. The nature of the complexing or chelating agent present within the plating bath may affect the degree of adsorption or absorption onto the particles and hence the degree of isolation of the particles from the active chemistry of the electroless plating. Hence, it may well be anticipated that a particulate matter stabilizer for a specific bath may, in fact, be of little improvement in another bath.

In addition to Examples 1–32, it has been found, as noted in Examples 33 and 34, that combination of binary particulate matter stabilizers, all having a nonionic compound, result in a significant synergistic effect, far greater than the additive effect associated with each of the particulate matter stabilizers alone under the same conditions.

In addition to the improvement in the stability for the electroless plating bath containing the particulate matter along with the particulate matter stabilizers, the deposits have been noted to provide composite coatings which were more homogeneous and smooth in comparison to the coatings derived without the presence of the particulate matter stabilizers. This observation was particularly noted in Examples 22, 24 and 34. In fact, in some instances in the absence of the particulate matter stabilizer, the coatings were powdery and of poor adhesion. Hence, it appears that the incorporation of the particulate matter stabilizer provides both with improved electroless plating stability as well as superior resulting deposits. In addition it has been noted that inclusion of particulate matter stabilizers Nos. 3 and 15, which were incorporated into a conventional electroless plating bath, has provided more reflective coatings in comparison to coatings resulting from an electroless plating bath alone without the particulate matter stabilizers.

The results of Examples 1–35 demonstrate that the concentration for the particulate matter stabilizer(s) is generally in a few grams or a fraction of a gram per liter of bath. By contrast to the present findings of incorporating the particulate matter stabilizers, it is of interest to note that conventional electroless stabilizers are generally present in electroless plating baths in/a few milligrams/liter and less.

Though the above examples were primarily illustrated with respect to electroless nickel plating baths, it is within the spirit of the present invention that other electroless plating compositions (e.g., copper, cobalt, gold, palladium, and alloys) along with the utilization of particulate matter fall within the spirit of this invention.

Analysis of Table 1 and other relevant results pertaining to the zeta potential displacement generally shows that anionic (PMS) compounds as particulate matter stabilizer cause a zeta potential shift or displacement of at least 15 mv, whereas cationic particulate matter cause a zeta potential shift of at least 10 mv though many have caused a shift of 70 mv and above. By contrast to the cationics and anionics, nonionic particulate matter stabilizers have generally resulted in a small zeta potential shift of a few mv (e.g., 5 mv and above).

While we do not wish to be bound by theory it is conceivable that both cationics and anionics participate by electrostatic interreaction with the particulate matter whereas nonionics interreact with the particulate matter in a steric type interreaction.

It is thus recognized that, in addition to the particles selected in Examples 1-24, other particulate matter may be substituted singly or in combinations. The substitution of such other particles does fall within the spirit of this invention.

It is also recognized that, although in the present invention aluminum substrates have been used as a vehicle for deposition, many other substrates may be used which fall within the spirit of this invention. In addition, after the deposition of the composite coating, further step(s) may take place, such as heat treatment to provide greater hardness of the matrix and/or improved adhesion and cohesion of the coating, or surface smoothing, all such steps being well documented in the prior art.

It is noted that the inclusion of the particulate matter stabilizer increases the tolerance of the plating bath towards the addition of anxilliary palladium.

Appendix I: Particulate Matter Stabilizers

| PMS # | Type | Chemical Structure |
|---|---|---|
| 1 | A | Sodium salts of polymerized alkyl naphthalene sulfonic acids |
| 2 | A/N | Disodium mono ester succinate (anionic and nonionic groups) 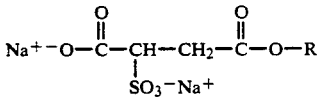 |
| 3 | C | CatFloc (manufactured by Calgon Corp.) Cationic polyelectrolyte; no structural information. |
| 4 | A | Potassium fluorinated alkyl carboxylates (FC-128, product of 3M) |
| 5 | A | Sodium n-Octyl Sulfate $CH_3(CH_2)_7SO_4^-Na^+$ |
| 6 | A | Sodium di(2-ethyl-hexyl) sulfosuccinate 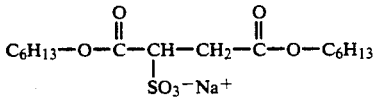 |
| 7 | A | Potassium perfluoroalkyl sulfonates (FC-98; Product of 3M) |
| 8 | N | Fluorinated alkyl polyoxyethylene ethanols (FC-170; Product of 3M) |
| 9 | A | Sodium hydrocarbon sulfonate (Avitone F; Product of Du Pont) |
| 10 | A | Sodium lignin sulfonate (Orzar S; Product of Crown Zellerbach) |
| 11 | A | Sodium dodecylbenzene sulfonate |
| 12 | A | Disodium alkyl (8-18) amidoethanol sulfosuccinate |
| 13 | A | Sodium isopropylnaphthalene sulfonate 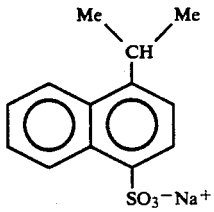 |
| 14 | C | Tallow trimethyl ammonium chloride |

-continued

Appendix I: Particulate Matter Stabilizers

| PMS # | Type | Chemical Structure |
|---|---|---|
| | | Tallow $-\overset{+}{N}(CH_3)_3$ $Cl^-$ |
| | | Tallow = $C_{16}$ and $C_{18}$ chain lengths and some unsaturation |
| 15 | N | 2,4,7,9-tetramethyl-5-decyn-4,7-diol 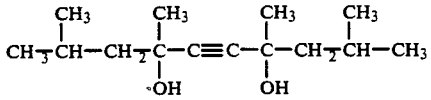 |
| 16 | A | Sodium salts of polymerized substituted benzoid alkyl sulfonic acids |
| 17 | N | 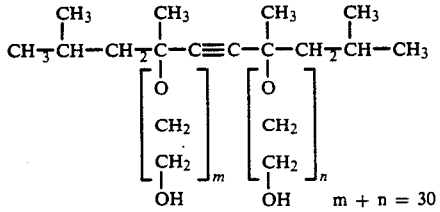 m + n = 30 |
| 18 | C | Lauryl trimethyl ammonium chloride |
| | | $CH_3(CH_2)_{11}-\overset{+}{N}(CH_3)_3$ $Cl^-$ |
| 19 | C | 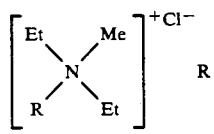 R = polyoxypropylene radical $-(CH_2CH(CH_3)O)_x-$ |
| 20 | A | Sodium alkyl sulfonate $C_{18}H_{35}SO_3^-Na^+$ |
| 21 | Amphoteric | N-Oleyl betaine 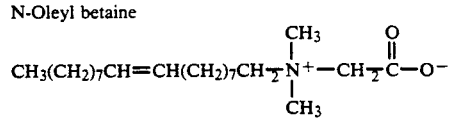 |

A — Anionic
C — Cationic
N — Nonionic

We claim:

1. An electroless plating composition which comprises a source for a metal ion, an electroless plating reducing agent, insoluble particulate matter dispersed therein and a quantity of particulate matter stabilizer, and wherein said particulate matter stabilizer is an admixture of a nonionic compound along with a member selected from the group consisting of anionics, cationics, and amphoterics, and mixtures thereof.

2. The composition according to claim 1 wherein said metal ions are nickel.

3. The composition according to claim 1 wherein said particulate matter is a wear resistant particle.

4. The composition according to claim 1 wherein said particulate matter is a lubricating particle.

5. The composition according to claim 1 wherein said particulate matter stabilizer is an organic non-fluorinated compound.

6. The composition according to claim 1 wherein said particulate matter stabilizer is an organic fluorinated compound.

7. The composition according to claim 5 wherein said stabilizer is a surfactant.

8. The process according to claim 6 wherein said stabilizer is a nonionic surfactant in combination with a cationic surfactant.

9. An electroless plating composition which comprises a source for a metal ion, an electroless plating reducing agent, insoluble particulate matter dispersed therein and a quantity of particulate matter stabilizer, said particulate matter stabilizer being an amphoteric compound.

10. The composition according to claim 9 wherein said amphoteric compound is a surfactant.

11. The composition according to claim 9 wherein said amphoteric compound is a dispersant.

12. The composition according to claim 1 wherein the incorporation of said particulate matter stabilizer increases the tolerance for said composition to the addition of anxillary palladium source.

13. An electroless plating composition comprising a source of a metal salt, an electroless reducing agent, a complexing agent and/or chelating agent, insoluble particulate matter dispersed therein, an electroless plating stabilizer and a particulate matter stabilizer being capable of shifting the zeta potential for said insoluble particulate matter by at least 10 mv in comparison to the measured zeta potential of said insoluble particulate matter alone in water.

14. The composition according to claim 10 wherein said surfactant is a fluorocarbon type.

15. The composition according to claim 10 wherein said surfactant is a hydrocarbon.

16. The composition according to claim 9 wherein said metal ion is nickel.

17. The composition according to claim 9 wherein said reducing agent is sodium hypophosphite.

18. An electroless plating composition comprising a source of metal salt, an electroless reducing agent, a complexing agent or chelating agent, insoluble particulate matter dispersed therein, and a particulate matter stabilizer, said stabilizer is a non-ionic surfactant with an HLB number of 17.

19. The composition according to claim 18 wherein said insoluble particulate matter is a lubricating particle.

20. The composition according to claim 1 further containing ammonium ions.

21. The composition according to claim 9 further containing ammonium ions.

22. The composition according to claim 13 further containing ammonium ions.

23. The composition according to claim 18 further containing ammonium ions.

24. An electroless plating composition comprising a source of a metal salt, an electroless reducing agent, a complexing agent and/or chelating agent, insoluble particulate matter dispersed therein and a non-ionic particulate matter stabilizer capable of shifting the zeta potential for said insoluble particulate matter by at least 5 mv in comparison to measured zeta potential of said insoluble particulate matter alone in water.

25. The composition according to claim 24 further containing ammonium ions.

26. The composition according to claim 24 wherein said non-ionic particulate matter is a hydrocarbon type compound.

27. The composition according to claim 24 wherein said insoluble particulate matter is a wear-resistant particle.

28. An electroless plating composition comprising a source of a metal salt, an electroless reducing agent, a complexing agent and/or chelating agent, insoluble particulate matter dispersed therein and a cationic particulate matter stabilizer capable of shifting the zeta potential for said insoluble particulate matter by at least 10 mv in comparison to measured zeta potential of said insoluble particulate matter alone in water.

29. The composition according to claim 28 further containing ammonium ions.

30. The composition according to claim 28 wherein said non-ionic particulate matter is a hydrocarbon type compound.

31. The composition according to claim 28 wherein said insoluble particulate matter is a wear-resistant particle.

32. An electroless plating composition comprising a source of a metal salt, an electroless reducing agent, a complexing agent and/or chelating agent, insoluble particulate matter dispersed therein and an anionic particulate matter stabilizer capable of shifting the zeta potential for said insoluble particulate matter by at least 15 mv in comparison to measured zeta potential of said insoluble particulate matter alone in water.

33. The composition according to claim 32 further containing ammonium ions.

34. The composition according to claim 32 wherein said non-ionic particulate matter is a hydrocarbon type compound.

35. The composition according to claim 32 wherein said insoluble particulate matter is a wear-resistant particle.

36. The composition according to claim 1 wherein said particulate matter stabilizer is the admixture of a non-ionic compound along with an anionic compound.

37. The composition according to claim 1 wherein said particulate matter stabilizer is the admixure of a non-ionic compound along with an amphoteric compound.

* * * * *